US005322717A

United States Patent [19]

Killian

[11] Patent Number: 5,322,717

[45] Date of Patent: Jun. 21, 1994

[54] ANIMATED OUTDOOR ORNAMENT

[76] Inventor: William R. Killian, 2017 Roy Ave., Abington, Pa. 19001

[21] Appl. No.: 93,785

[22] Filed: Jul. 20, 1993

[51] Int. Cl.[5] ..... A47G 7/02; F41H 3/00

[52] U.S. Cl. ..... 428/7; 239/69; 428/16; 428/34.1; 428/919; 446/73

[58] Field of Search ..... 428/919, 7, 34.1, 16; 446/73, 75, 72; 239/201, 206, 211, 69

[56] References Cited

U.S. PATENT DOCUMENTS 2,811,808 11/1957 Briese ..... 239/211 X 3,921,911 11/1975 Sheets ..... 428/919 X

*Primary Examiner*—Henry F. Epstein

*Attorney, Agent, or Firm*—Logan & Simkanich

[57] ABSTRACT

The present invention is an animated ornamental fixture for installation in a garden or similar outdoor area frequented by visitors. Upon the approach of an observer, the fixture commences operation to surprise and entertain by elevating a decorative flowerpot to reveal a small figurine beneath, and optionally emitting sounds, and after departure of the observer, the fixture ceases operation.

21 Claims, 5 Drawing Sheets

ANIMATED OUTDOOR ORNAMENT

FIELD OF THE INVENTION

The present invention is an animated ornamental fixture for installation in a garden or similar outdoor area frequented by visitors. Upon the approach of an observer, the fixture commences operation to surprise and entertain, and after departure of the observer, the fixture ceases operation.

BACKGROUND OF THE INVENTION

The prior art is replete with references to decorative figures which are placed in outdoor locations to enhance the decor of gardens and the like. Even in antiquity, statues of people, animals, and other figures were installed along paths, in gardens, and in courtyards and similar public areas. Such figures have been sculpted in various media, and even from living plants in the art known as topiary.

With the advent of the machine age, moving figures were constructed, and undoubtedly, some of these automatons were installed outdoors. However, such moving figures required actuation prior to the approach of an observer, and remained in action until deactivated by an attendant. Furthermore, the purpose of the figures of the prior art was to draw attention directly. They were thus not hidden or disguised, but were, rather, featured centerpieces of their owners' gardens and courtyards.

BRIEF DESCRIPTION OF THE INVENTION

The animated ornament of the present invention comprises a generally cylindrical housing which may be buried in the earth, and a decorative lid, generally appearing to be a flower pot, which covers the upper end of the housing. Concealed within the housing is a mechanism for elevating the lid to reveal a figure beneath, generally in the form of a small animal such as a rabbit or squirrel. Also concealed within the housing is a sensor circuit for detecting the presence of a predetermined condition or coincidence of conditions necessary to permit operation of the animated ornament. This circuit is, in turn, connected to external sensors located either on the decorative lid or a some location distant from the animated ornament.

Upon sensing the required conditions (e.g., proximity of an animal of at least a predetermined size, daylight, sound of a predetermined frequency or other characteristic, and the like), the mechanism is energized to raise the ornamental lid, thus revealing the figure beneath. Simultaneously, an optional sound may be emitted from the ornament to draw the attention of observers. After a predetermined period of time, the mechanism is reversed to lower the lid, and re-hide the figure. This cycle may be repeated at predetermined or random time intervals until the required conditions no longer persist, or may be terminated earlier.

DETAILED DESCRIPTION OF THE INVENTION

Figure 1:
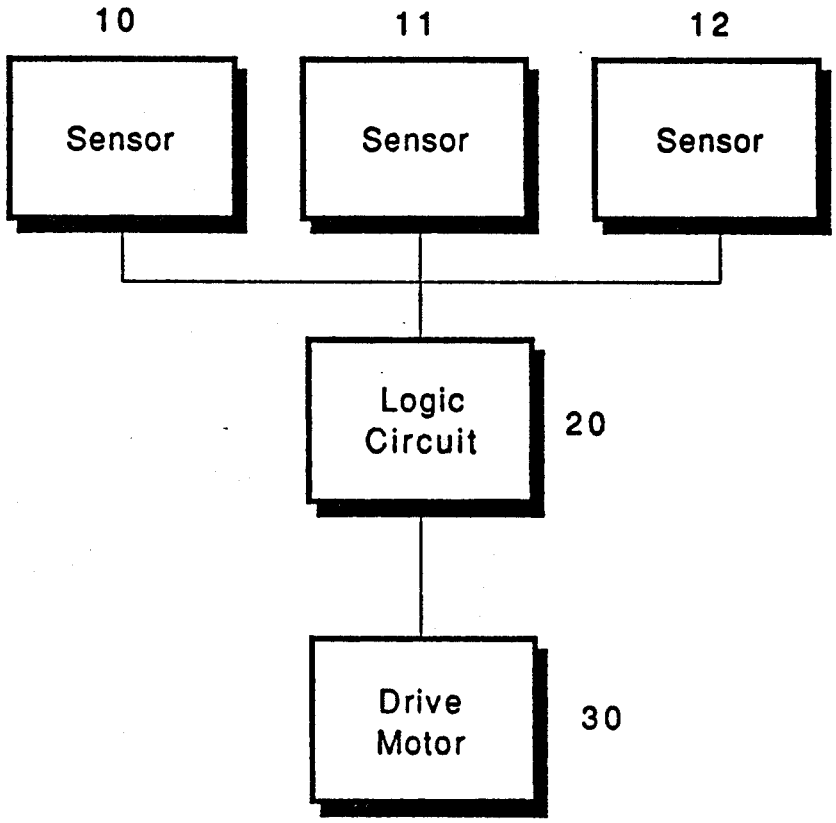
FIG. 1 depicts a block diagram of the animated ornament of the present invention.

Referring now to FIG. 1, there is shown a block diagram of the elements which comprise the animated ornament of the present invention. Sensors 10, 11, and 12 represent a variety of the possible sensors which may be employed, separately or in combination. Sensor 10 is an ultrasonic emitter/receiver system which is adapted to provide information about the distance between the sensor and a moving observer. This distance information is transferred to actuation logic circuit 20, which contains a set of predetermined criteria for enabling a lid drive mechanism that animates the ornament, an example of one such mechanism being a motor 30 as shown and further described below. Similarly, and optionally, sensor 11 is a passive infrared detector system capable of determining the motion of a source of infrared radiation (such as an approaching human or other animal). Sensor 12 is optionally a photoelectric sensor capable of determining the level of ambient light. Other sensors and inputs to actuation logic circuit 20 may include a clock for determining elapsed time, time of day, day of the week, or date, a microphone and associated circuitry for determining the presence and level of ambient noise or of noise within a particular domain of frequency, intensity, or content, such as human speech, a pressure switch which is actuated by a footstep on a flagstone or similar tread, a photoelectric beam sensor which is actuated by passage of an observer through its projected beam, or any similar sensor.

Upon a predetermined condition or coincidence of conditions (e.g., it is daylight, and a large infrared source crosses at least 10° of the field of view of the passive infrared sensor, a signal is generated which actuates lid drive motor 30 to animate the ornament.

Figure 2:
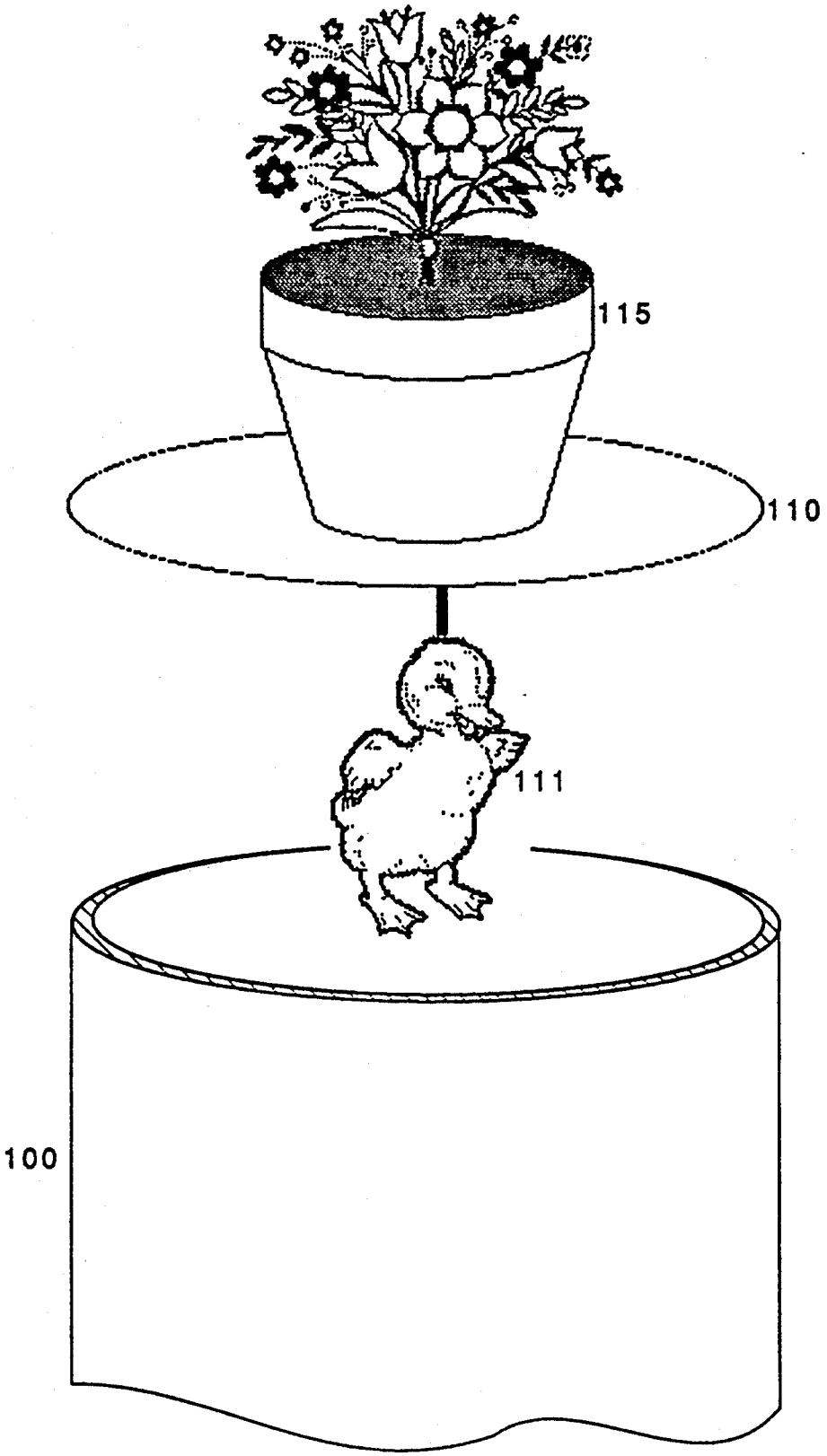
FIG. 2 depicts a front view of one embodiment of the animated ornament of the present invention.

Referring now to FIG. 2, there is shown a front view of one embodiment of the animated ornament of the present invention. Cylindrical housing 100 is preferably fabricated of a weather-resistant plastic material such as common 4 inch diameter polyvinyl chloride (PVC) drain pipe. Lid base 110 is fabricated from a similar PVC material, and is sized to completely seal the upper end of housing 100. Mounted beneath lid base 110 is figurine 111. Housing 100 is provided with a sealed lower end cap (not shown), which is sealed to prevent the entry of water into housing 100. Power supply wires (not shown) may optionally exit through a caulked hole in said cap, or in the side of housing 100. Located on the top surface of lid base 110 is decorative material 115, which provides an aesthetically pleasing camouflage such as a flower pot containing artificial flowers, or the like.

Figure 3:
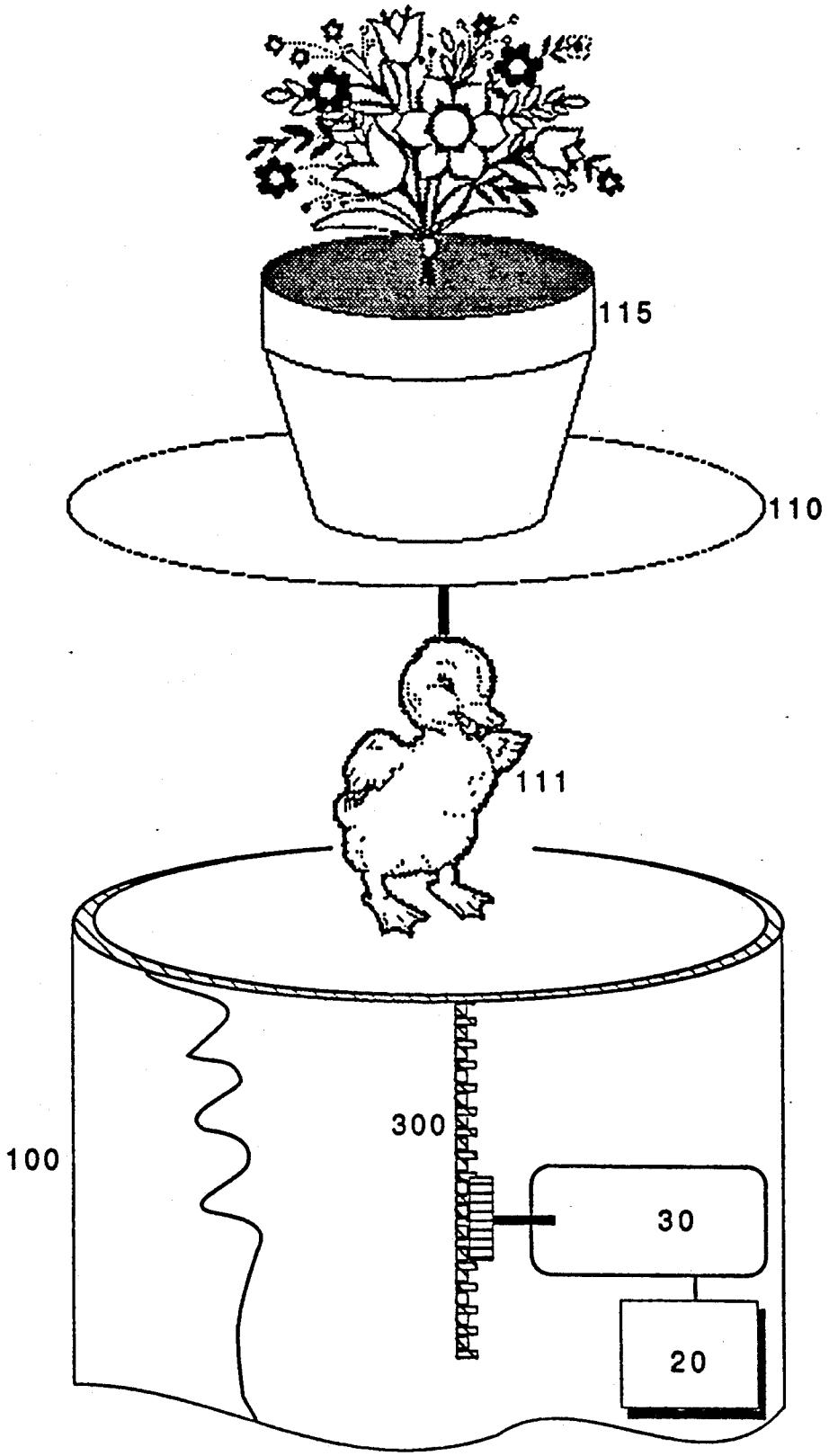
FIG. 3 depicts a partial section view of the animated ornament of the present invention.

Referring now to FIG. 3, there is shown a partial section view of the animated ornament of the present invention. Contained within housing 100 are shown drive assembly 300, figurine 111, lid drive motor 30, and actuation logic circuit 20.

Figure 4:
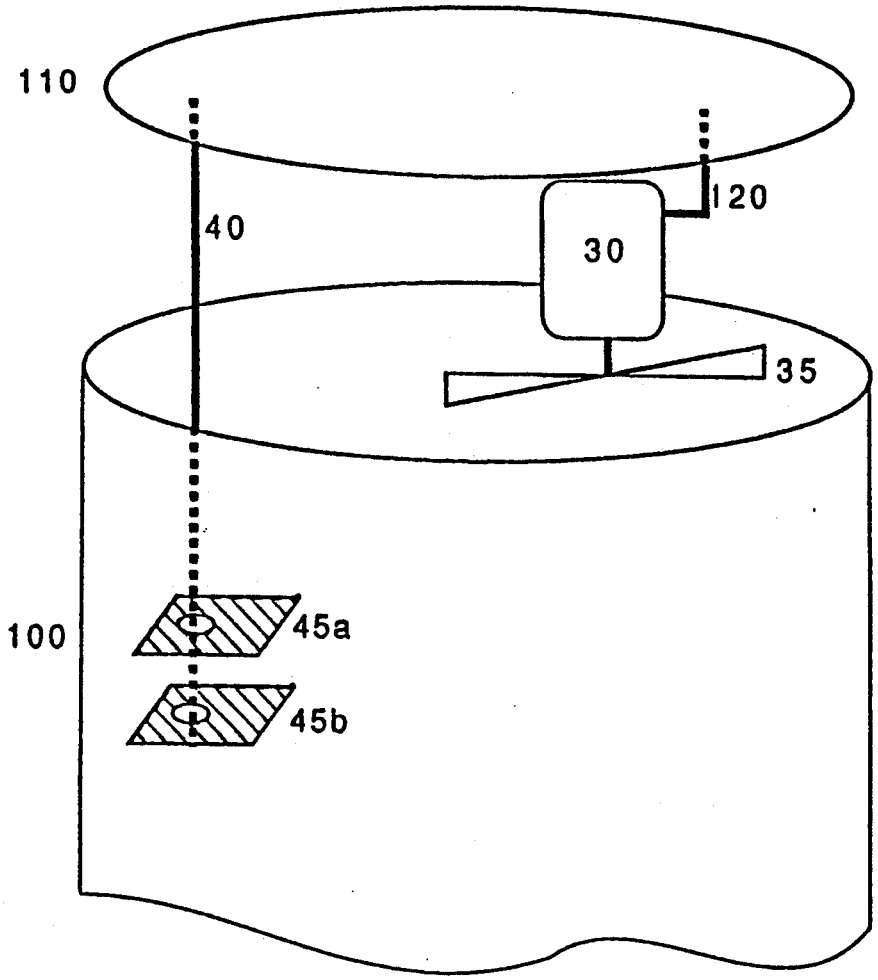
FIG. 4 depicts a plan view of the actuation mechanism of the present invention.

FIG. 4 reveals in greater detail the lid drive assembly of the present invention. Mounted on support bracket 120 beneath lid base 110 is lid drive motor 30. Attached to the shaft of motor 30 is fan blade assembly 35. Secured to the underside of lid base 110 is guide rail 40, which extends through apertures in guide brackets **45*a* and 45*b* mounted to the inner wall of housing 100. Optionally, additional guide rails and guide brackets may be used, as required. Upon actuation of motor 30, fan 35 is driven to provide a lifting force of slightly greater magnitude than the weight of lid base 110, decorative material 115 (not shown), and figurine 111 (not shown). For as long as power is supplied to motor 30, the entire assembly is lifted relative to the upper end of housing 100, thus revealing figurine 111 beneath lid base 110 and decorative material 115**. The effect is that of a small animal rising beneath a flower pot, carrying the pot on its head.

Figure 5:
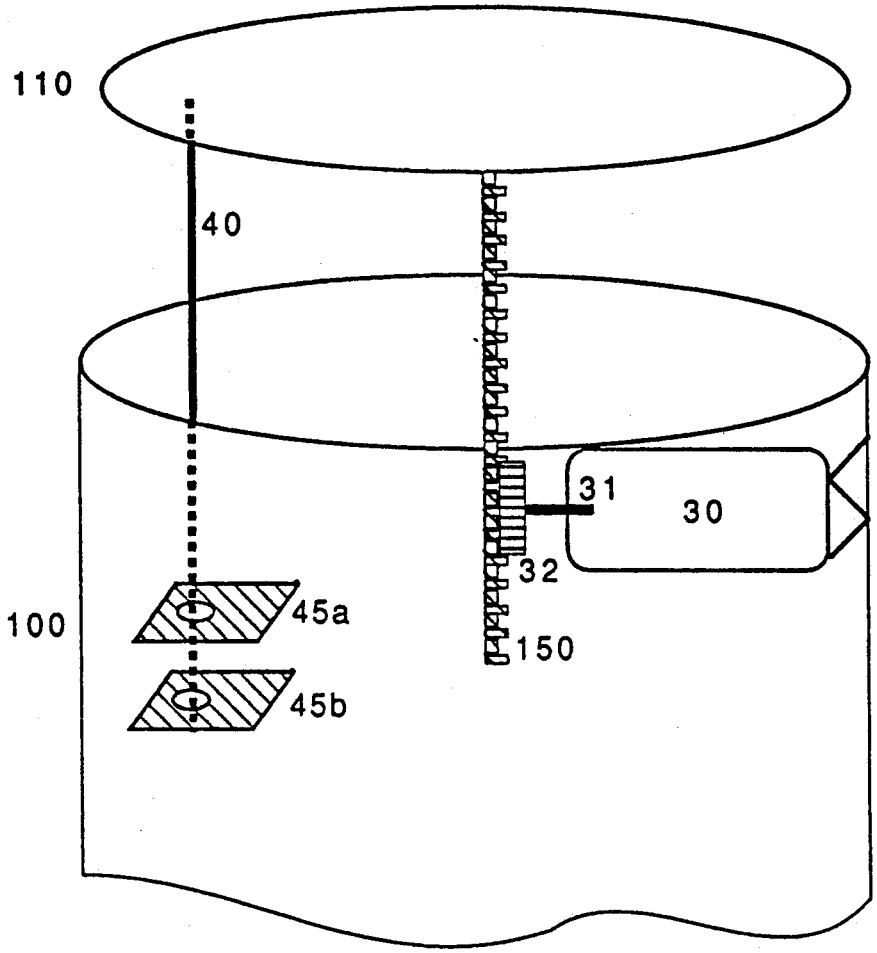
FIG. 5 depicts a plan view of an alternative embodiment of the actuation mechanism of the present invention.

FIG. 5 depicts an alternative drive mechanism comprising motor 30 which is fixed to the interior surface of housing 100 and has a gear 32 fitted to its shaft 31. With or without optional reduction gearing, motor 30 is connected to rack 150 which is mounted vertically to the underside of figurine 111 (not shown). Upon actuation of motor 30, its shaft turns sufficiently to advance rack 150 and the associated figurine, lid base 110, and decorative material 115 (not shown) vertically upward a sufficient distance to reveal figurine 111 to an observer. After actuation, motor 30 is reversed an equivalent number of revolutions to withdraw figurine 111 (not shown) into housing 100.

Another alternative embodiment of the ornament of the present invention is the fitting of decorative material 115 to the covering cap of a conventional elevating lawn sprinkler system. Upon actuation of the sprinkler, the cap elevates to raise decorative material 115, and reveal a decorative figurine disposed as a cover for the sprinkler head. Thus, in operation, it may be made to appear that a small animal or other character is projecting a stream of water from its mouth (or other bodily orifice) upon the ground surrounding the sprinkler head. When not in operation, only a small decorative flower pot or other ornament is visible.

Statement of Industrial Utility

The present invention may be useful as an entertainment or decorative embellishment in a garden, courtyard, or similar space frequented by human visitors.

It will be appreciated by those skilled in the art that the present invention has been described with reference to specific examples which are not intended as limitations, and which are but a few of the variations which are possible without departing from the spirit of the invention. Accordingly, the scope of the invention should be determined only with reference to the appended claims.

We claim as our invention:

1. An animated ornamental fixture comprising:

(a) a substantially water-tight housing having a moveable upper lid;

(b) a decorative item mounted on the top surface of said upper lid;

(c) a decorative figurine mounted beneath the lower surface of said upper lid, and located substantially within said housing;

(d) a drive mechanism for elevating said upper lid, said decorative item, and said figurine in a manner so as to reveal said figurine to an observer;

(e) one or more sensors for sensing conditions under which to actuate said drive mechanism; and (f) a logic circuit for determining whether to actuate said drive mechanism by combining the outputs of said sensors with a predetermined logical function or truth table, the output of said circuit being an actuation signal to said drive mechanism.

2. The animated ornamental fixture drive mechanism of claim 1 further comprising a fan motor and fan blade for propelling said upper lid.

3. The animated ornamental fixture drive mechanism of claim 1 further comprising a motor, drive gear, and linear rack gear fixedly attached to said upper lid for moving said upper lid in a vertical direction.

4. The animated ornamental fixture drive mechanism of claim 1 further comprising a motor, drive gear, and linear rack gear fixedly attached to said decorative figurine for moving said decorative figurine in a vertical direction.

5. The animated ornamental fixture of claim 1 wherein at least one of said sensors is a passive infrared detector.

6. The animated ornamental fixture of claim 1 wherein at least one of said sensors is an ultrasonic range detector.

7. The animated ornamental fixture of claim 1 wherein at least one of said sensors is an ultrasonic motion detector.

8. The animated ornamental fixture of claim 1 wherein at least one of said sensors is a photo electric cell.

9. The animated ornamental fixture of claim 1 wherein at least one of said sensors is a sound detector.

10. The animated ornamental fixture of claim 1 wherein said logic circuit further comprises a real-time clock.

11. The animated ornamental fixture of claim 10 wherein said real-time clock provides a predetermined duration of operation of said fixture following a first actuation.

12. The animated ornamental fixture of claim 1 wherein said actuation signal is output in response to the sensed presence of human observers in close proximity to said fixture.

13. An apparatus comprising:

(a) a weather resistant housing having a moveable upper lid;

(b) a decorative figurine located within said housing and beneath the lower surface of said upper lid;

(c) a drive mechanism for elevating said figurine to reveal said figurine to an observer;

(d) one or more sensors for sensing conditions under which to activate said mechanism; and (e) a sensor circuit for actuating said drive mechanism based upon signals from said sensors.

14. An apparatus in accordance with claim 13 further comprising:

a decorative item mounted on the top surface of said upper lid.

15. An apparatus in accordance with claim 13 wherein one of said sensors is an ultrasonic motion detector.

16. An apparatus in accordance with claim 13 wherein one of said sensors is a sound detector.

17. An apparatus in accordance with claim 13 wherein said sensor circuit comprises a real-time clock.

18. An apparatus in accordance with claim 13 wherein said drive mechanism is actuated in response to the sensed presence of a human in close proximity to the apparatus.

19. An apparatus in accordance with claim 14 wherein said drive mechanism is actuated in response to the sensed presence of a human in close proximity to the apparatus.

20. An apparatus in accordance with claim 15 wherein a real-time clock provides a predetermined duration of operation of said apparatus following a first actuation.

21. An animated apparatus comprising:

(a) a weather resistant housing, said housing having a moveable upper lid;

(b) a decorative item mounted on the top surface of said upper lid;

(c) a decorative figurine mounted beneath the lower surface of said upper lid, and located substantially within said housing;

(d) one or more sensors for sensing conditions under which to activate said drive mechanism;

(e) a drive mechanism for elevating said figurine out of said housing; and (f) a logic circuit for actuating said drive mechanism based upon signals received from said sensors.

* * * * *